United States Patent [19]

Niimi

[11] Patent Number: 4,904,998

[45] Date of Patent: Feb. 27, 1990

[54] LIGHTING PEG WITH VARIABLE PULSATION RATE

[75] Inventor: Kikuo Niimi, Aichi, Japan

[73] Assignee: Kictec Incorporation, Nagoya, Japan

[21] Appl. No.: 282,480

[22] Filed: Dec. 9, 1988

[30] Foreign Application Priority Data

May 30, 1988 [JP] Japan ..... 63-70408[U]

[51] Int. Cl.[4] ..... E01F 9/00; G08G 1/00; B60Q 7/00

[52] U.S. Cl. ..... 340/908.1; 340/908; 340/427; 340/321; 340/908; 340/917; 340/942; 364/900; 315/149; 315/155; 315/159; 250/215; 250/239; 307/10.8

[58] Field of Search ..... 340/917, 942, 432, 908, 340/908.1, 427, 469, 473, 321; 362/900; 315/82, 155, 159, 149; 250/215, 239; 307/10.8

[56] References Cited

U.S. PATENT DOCUMENTS 4,290,047 9/1981 Latta, Jr. ..... 315/149

FOREIGN PATENT DOCUMENTS 39915 9/1977 Japan .
68113 5/1986 Japan .
152013 9/1986 Japan .

*Primary Examiner*—Donnie L. Crosland
*Attorney, Agent, or Firm*—Ladas & Parry

[57] ABSTRACT

In a lighting peg with a variable pulsation rate including a square outer casing provided with a solar cell and a battery and adapted to be installed at an intersection of two roads, light emitting diodes and a photoelectric conversion element are provided on each side surface of the square outer casing. An ambient light sensor for detecting ambient light and a pulse signal generating circuit for generating pulse signals are further provided together with vehicle sensors, each including the photoelectric conversion element, a differential circuit and a comparator. A control circuit including OR gates for receiving the outputs of the vehicle sensors, discriminating circuits for discriminating the outputs of the OR gates and pulsation rate control circuits for controlling the rate of pulsation are further provided in the lighting peg so that, when a vehicle approaches the road intersection along a first road is detected by one of the vehicle sensors, the rate of pulsation of light emitted from the light-emitting diodes into the second road is varied in a predetermined manner.

4 Claims, 2 Drawing Sheets

LIGHTING PEG WITH VARIABLE PULSATION RATE

BACKGROUND OF THE INVENTION

This invention relates to a variable frequency lighting peg adapted to be installed at the center of road intersections, and constructed so that when a vehicle is approaching the intersection along one of the roads, the rate of pulsation of light emitted from the peg to another road can be varied for warning the driver of a car coming along the second road to exercise caution with respect to the approaching vehicle on the first road.

Various lighting pegs have been heretofore proposed. For instance, Japanese Utility Model Laid-Open Publication No. 152013/1986 discloses a road-surface mounted type of signaling device comprising a solar cell, battery, and a light-emitting diode, and that determines the light intensity of the surrounding area, and that is automatically operate so that the light pulsates throughout the night. Also, in an automatic flashing lamp indicating the edge (or shoulder) of a road, a first photoelectric conversion element senses the ambient light, while a second photoelectric conversion element senses light from a vehicle so that the lamp operates to pulsate (refer to Japanese Utility Model Publication No. 39915/1977). Otherwise proposed is a self-lighting type of road marking device wherein ambient light is detected from the output voltage of a solar cell, while light from a vehicle is sensed by a photoelectric conversion element, and a light emitting diode is thereby operated so as to pulsate (for instance refer to Japanese Utility Model Laid-Open Publication No. 68113/1986).

As a result of recent traffic clogging in the majority of principal roads, back roads of narrower widths tend to be utilized as detours. Ordinarily, the provision of regular traffic signals is not sufficient in these back roads, and therefore lighting pegs and the like of the automatic flashing type are frequently used to supplement the traffic signals. However, since there is a limitation in the capability of such auxiliary devices, the number of traffic accidents occurring in the back roads is constantly increasing and a counter measure to this problem has been urgently required.

Among the aforementioned conventional techniques, a lighting peg that operates to pulsate throughout the night is adapted to indicate the presence of an intersection of roads, and to warn drivers of vehicles and pedestrians to exercise caution. However, the reason for most of the intersection accidents is in the disobeyance of temporary stopping rules and carelessness of drivers of vehicle coming along the other road from either the right or left directions. Therefore simply indicating the presence of an intersection is not sufficient to preventing such accidents.

In another of the conventional techniques where the peg pulsates only while a vehicle approaches the intersection, the presence of the intersection is not indicated to pedestrians or the riders of bicycles. Furthermore, when a vehicle comes along a first road of an intersection, and thereafter another vehicle approaches the intersection along another road, the approach of the second vehicle is not informed to the driver of the first-mentioned vehicle, and therefore such a technique cannot be considered to be satisfactory.

SUMMARY OF THE INVENTION

A primary object of this invention is to provide a lighting peg with a variable pulsation rate capable of overcoming the above described difficulties of the conventional devices.

Another object of the invention is to provide a lighting peg with a variable pulsation rate capable of indicating an intersection of two roads at night time by emitting light pulses of a predetermined pulsation rate.

Still another object of the invention is to provide a lighting peg with a variable pulsation rate wherein the rate of pulsation of the light emitted toward one road can be increased to two or four times greater than the predetermined pulsation rate according to the condition of vehicles incoming along the other road.

These and other objects of the present invention can be achieved by a lighting peg with a variable pulsation rate comprising a square outer casing provided with a solar cell and a battery, and adapted to be installed at an intersection of two roads; light-emitting diodes and a photoelectric conversion element provided on each side surface of the outer casing; an ambient light sensor comparing the output voltage of the solar cells with a reference voltage; a pulse signal generating circuit operated by the output of said ambient light sensor so as to generate a number of pulse signals of different frequencies; upon operation of the pulse signal generating circuit, the light-emitting diodes provided on all of the side surfaces being operated by one of the pulse signals having a lowest pulsation rate; vehicle sensors each comprising the afore-mentioned photoelectric conversion element series connected with a variable resistor, a differential circuit connected across said variable resistor, and a comparator comparing the output of the differential circuit with a reference voltage; and a control circuit comprising OR gates each receiving the output of an opposite pair of the vehicle sensors, discriminating circuits discriminating the outputs of the OR gates, and the rate of pulsation control circuits which control the rate of pulsation of light emitted from the light-emitting diodes toward the intersecting roads in accordance with those of the pulse signals generated from the pulse signal generating circuit.

More specifically, when the output of the ambient light sensor is brought to the high level in the evening, the pulse signal generating circuit is operated to generate a number of pulse signals of different rates, and in the case where a vehicle approaches the intersection from either of two directions along a first road, rate of pulsation of the light emitted from the peg in the opposite two directions along a second road is increased to, for instance, a value twice as large as the rate of pulsation of the light ordinarily emitted from the peg at night.

At this time, should another vehicle approaches the intersection along the second road before the vehicle in the first road passes through the intersection, the rate of pulsation of the light emitted from the lighting peg in two directions along the first road is also increased to a value twice as large, while the rate of pulsation of the light emitted from the peg in two directions along the second road is increased to, for instance, four times as large as what it is ordinarily.

When the vehicle in the first road thereafter passes through the intersection, the rate of pulsation of the light emitted along the second road is reduced to the ordinary value.

In addition, since each of the aforementioned vehicle sensors includes a differential circuit connected to the output of the photoelectric conversion element, the sensor can detect only varying rates of light, thereby substantially eliminating erroneous operation caused by the ambient light.

DESCRIPTION OF THE PREFERRED EMBODIMENT

A preferred embodiment of this invention will now be described with reference to the accompanying drawings.

Figure 1:
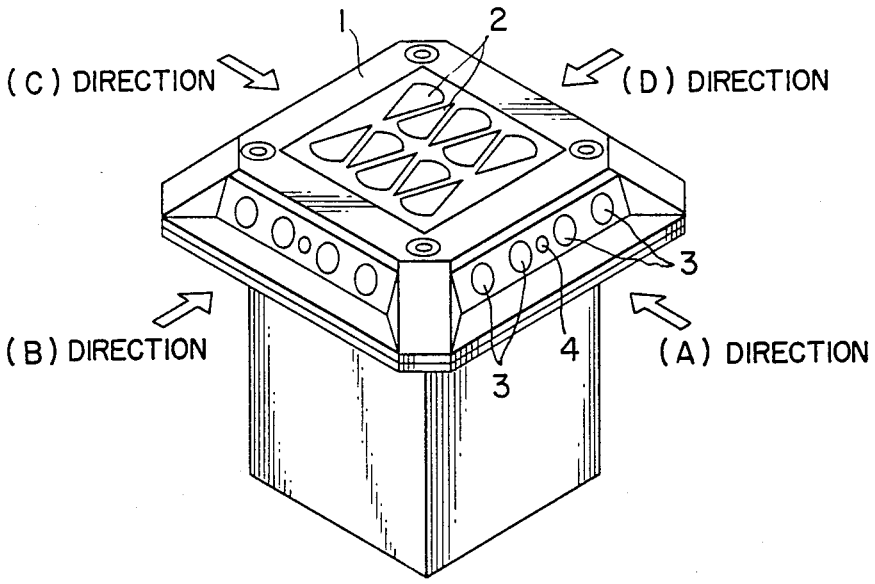
FIG. 1 is a perspective view showing a preferred embodiment of the present invention.
Figure 2:
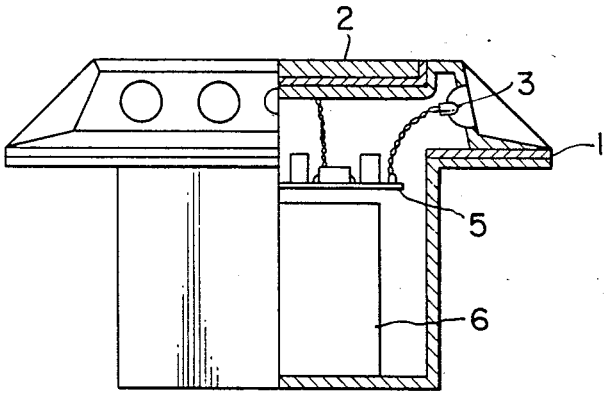
FIG. 2 is an elevational view, partly in section, of the embodiment shown in FIG. 1.

A lighting peg constituting the embodiment comprises an outer casing 1 of a square shape having four side surfaces as shown in FIGS. 1 and 2. A solar cell 2 is provided on an upper surface of the outer casing 1 while a number of phototransistors 4 operable as photoelectric conversion elements and a light-emitting diode 3 are provided on each of the four side surfaces of the outer casing 1. The solar cell 2, light-emitting diodes 3, phototransistors 4, and the battery 6 are connected to form an electric circuit 5 which is also installed in the casing 1.

Figure 3:
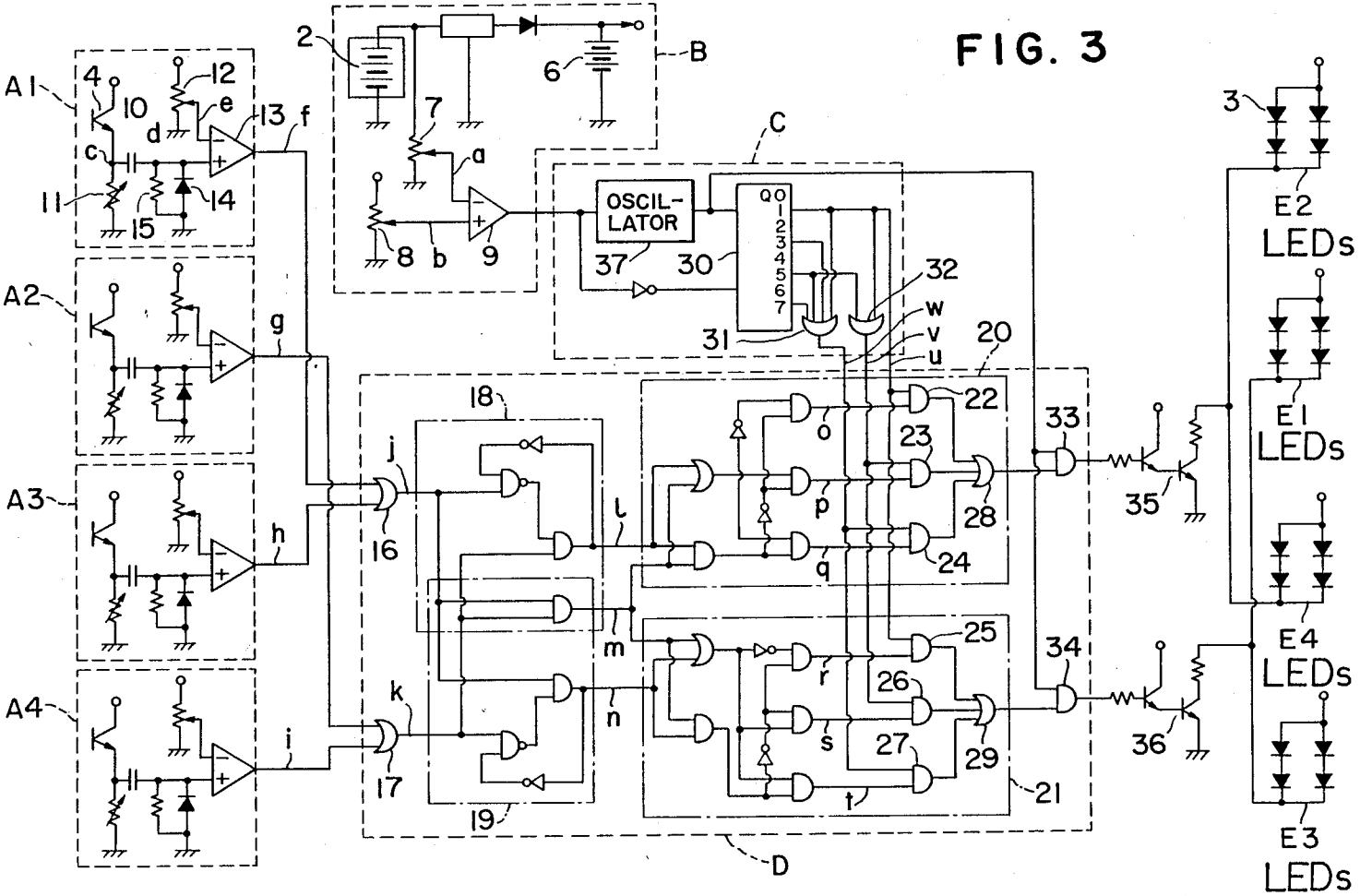
FIG. 3 is a diagram showing an electric circuit used in the embodiment.

FIG. 3 illustrates the electric circuit 5 which comprises vehicle sensor $A_1$, $A_2$, $A_3$ and $A_4$ for sensing the light of vehicles approaching the intersection from four directions (A), (B), (C) and (D) along the two roads, an ambient light sensor B for sensing light of the surrounding area, a pulse signal generating circuit C, light-emitting diode groups $E_1$, $E_2$, $E_3$ and $E_4$, and a control circuit D for controlling the light-emitting diode groups through energizing circuits 35 and 36 on the basis of the signals output from the vehicle sensors $A_1$, $A_2$, $A_3$ and $A_4$ which receive the light of vehicles approaching the intersection from the four directions of (A), (B), (C) and (D) as shown in FIG. 1.

The ambient light sensor B is constructed so that the output voltage of solar cell 2 is divided by variable resistor 7 into a voltage having a maximum value of $V_{DD}$-1 V, and a comparator 9 made of an operational amplifier compares the thus divided voltage with a reference voltage set by another variable resistor 8. The comparator 9 delivers an output of high level when the voltage at a point b is higher than the voltage at a point a, and conversely when the voltage at the point b is lower than the voltage of the point a, and the output of the comparator 9 becomes low level.

Each of the vehicle sensors $A_1$, $A_2$, $A_3$ and $A_4$ includes a phototransistor 4 connected in series with a variable resistor 11. The variable resistor 11 is adjusted beforehand so that in the evening, the voltage obtained at a point c is made equal to $V_{DD}$-1 V. A differential circuit comprising a capacitor 10 and a resistor 15 is connected to the subsequent stage, so that the variation of the voltage at the point is delivered from a point d. That is, when the voltage at the point c rises, the voltage of the point d rises in accordance with the voltage variation at the point c, and when the voltage at the point c is not varied, the voltage of the point d goes back to zero volts after a time period determined by the time constant of the differential circuit. When the voltage of the point c falls, the voltage of the point d becomes a negative value. However, by the effect of a diode 14 connected in a reverse polarity between the point d and the earth, the voltage of the point d goes back to zero volts within a short time. A comparator 13 compares the output of the differential circuit with a reference voltage set by a variable resistor 12, and when the output of the differential circuit is higher than the reference voltage, the output of the comparator 13 is made high level, but when the output of the differential circuit is lower than the reference voltage, the output of the comparator 13 is made low level.

The pulse generating circuit C comprises an oscillator 37, an octonary counter 30, OR gates 31 and 32, and an inverter. When the output of the comparator 9 of the ambient light sensor B is at the high level, the oscillator 37 oscillates at a duty cycle having a duration time sufficient for lighting the light-emitting diodes. At the same time, the reset input of the octonary counter 30 becomes low level, so that the counter 30 starts to operate so as to sequentially deliver pulse signals Q0 to Q7. As a consequence a pulse signal of a longest repetition period is delivered from a point U, while another pulse signal one half of that of the first-mentioned pulse signal is delivered from the point V due to the presence of an OR gate 32, and still another pulse signal having a rate $\frac{1}{4}$ that of the same pulse signal, is delivered from the point W due to the presence of another OR gate 31.

The control circuit D comprises discriminating circuits 18, 19, pulsation rate control circuits 20, 21, two OR gates 16, 17 and two AND gates 33, 34. When either one or both of the vehicle sensors $A_1$ and $A_3$ deliver an output or outputs of high level, the output of the OR gate 16 becomes high level. Likewise, when either one or both of the vehicle sensors $A_2$ and $A_4$ deliver an output or outputs of high level, the output of the OR gate 17 becomes high level. According to the variation of levels of the output points j and k of the OR gates 16, 17, the discriminating circuit 18 delivers outputs as shown in Table 1 from the points l and m. In a similar manner, according to the variation of levels of the same output points j and k of the OR gates 16, 17, the discriminating circuit 19 delivers outputs as shown in Table 2 from the points m and n.

TABLE 1

(H: high level, L: low level)

| | | Variation of levels | | | | | | | | |
|---|---|---|---|---|---|---|---|---|---|---|
| input | j | L | H | H | L | L | L | H | H | L |
| | k | L | L | H | H | L | H | H | L | L |
| output | l | L | L | L | H | L | H | H | L | L |
| | m | L | L | H | L | L | L | H | L | L |

TABLE 2

(H: high level, L: low level)

| | | Variation of levels | | | | | | | | |
|---|---|---|---|---|---|---|---|---|---|---|
| input | j | L | H | H | L | L | L | H | H | L |
| | k | L | L | H | H | L | H | H | L | L |
| output | m | L | L | H | L | L | L | H | L | L |
| | n | L | H | H | L | L | L | L | H | L |

The pulsation rate control circuit 20 is so constructed that when the levels of the points l and m are both low level, only a point o among three points o, p and q of the circuit 20 becomes high level, and when either one of the points l and m is at high level, only the point p among the points o, p and q becomes high level, and likewise, when both the points l and m are high level, only the point q among the three points o, p and q becomes high level. When the point o becomes high level, a pulse signal having a longest repetition period is delivered from an OR gate 28 of the pulsation rate control circuit 20. Likewise, when the point p becomes high level, a pulse signal having a repetition period of one half that of the longest, is delivered from the OR gate 28, and when the point g becomes high level, a pulse signal having a repetition period of $\frac{1}{4}$ that of the longest is delivered from the OR gate 28.

The pulsation rate control circuit 21 is also constructed so that the rate (or repetition period) of the output signal is controlled in a similar manner by the levels of the points m and n.

The AND gate 33 provided subsequent to the OR gate delivers a high level output when the outputs of the oscillator 37 and the OR gate 28 are both high level, and the AND gate 34 provided subsequent to the OR gate delivers an output of high level when the outputs of the oscillator 37 and the OR gate 29 are both at a high level.

The above described embodiment of this invention operates as follows, when the power source is applied in the day time, the output voltage of the solar cell provided in the ambient light sensor B becomes high, and a voltage divided from the output voltage rises to exceed of the reference voltage. Thus, the output of the comparator 9 becomes low level, so that the oscillator 37 in the pulse signal generating circuit C does not operate. At this time, the reset input of the octonary counter 30 becomes high level, and therefore the outputs from the u, v and w points of the counter are all brought to low level. As a consequence, the outputs of the AND gates 22, 23, 24, 25, 26 and 27 are all brought to the low level as well as the outputs of the OR gates 28 and 29 and the AND gates 33 and 34, so that the output of the light-emitting diode energizing circuits 35 and 36 are held at the low level and the light emitting diodes groups $E_2$, $E_1$, $E_4$ and $E_3$ are thus held in the OFF state. Furthermore, in the daytime, the voltages at the point c in the vehicle sensors $A_1$, $A_2$, $A_3$ and $A_4$ are not varied, so that the voltages at the point d is held lower then the reference voltage and the output of the comparators 13 are consequently brought down to the low level.

In the evening when it becomes dark, the output voltage of the solar cell in the ambient light sensor B is reduced. When the voltage at a point a is reduced to lower than the reference voltage at a point b, the output of the comparator 9 becomes high level. As a result, the oscillator 37 starts to operate, and since the reset input of the octonary counter 30 becomes low level, pulse signals of three different rates are obtained at the points u, v and w. At this time, the voltages of the point c in the vehicle sensors $A_1$, $A_2$, $A_3$ and $A_4$ are also reduced. However, the voltages at the point d are held at lower than the reference voltages at a point e, so that the outputs of the comparators 13 obtained at points f, g, h and i are held at a low level as well as the outputs obtained at points j and k from the OR gates 16 and 17. As a consequence, the voltages at the points l, m, n are brought to the low level as shown in the Tables 1 and 2, and only the voltages at points o and r are brought to the high level. Thus, the pulse signal of the longest period is delivered from the OR gates 28 and 29, and the output signals thus delivered are applied through the AND gates 33 and 34 to the energizing circuits 35 and 36, so that the light-emitting diode groups $E_2$, $E_1$, $E_4$ and $E_3$ are operated in accordance with the pulse signal of the longest period.

In the case where a vehicle or vehicles approach the intersection from (A) or (C) or both directions along a first road, a current flows through the phototransistor 4 in the corresponding sensors, thereby increasing the voltage of the point c, and therefore the voltage of the point d. When the voltage of the point d rises to exceed the reference voltage, the output of the comparator 13 in the corresponding sensor or sensors becomes high level together with the output of the OR gate 16. In this case, the point j becomes high level, leaving the point k at low level, so that the point l becomes high level while the point is left at low level. As a result, the point o becomes high level causing the AND gate 22 to deliver the pulse signal of longest period, the output of the AND gate 22 is sent through the OR gate 28 and the AND gate 33 to the diode energizing circuit 35, so that the light-emitting diode groups $E_2$ and $E_4$ are operated by the pulse signal of the longest period. On the other hand, the point m becomes low level and the point n becomes high level, thereby bringing the point s to high level, so that a pulse signal that is $\frac{1}{2}$ of the longest period is delivered from the AND gate 26, and the device energizing circuit 36 operates the light-emitting diode groups $E_1$ and $E_3$ directed to the second road at a pulsation rate twice as large as that of the initial pulsation rate of the longest period.

When a vehicle running along the first road in (A) or (C) direction passes through the intersection, thereby reducing the light received by the vehicle sensor $A_1$ or $A_3$ or both of them, the voltage at the point d in the sensor is reduced. When the voltage of the point d is reduced to a value lower than the reference voltage, the output of the comparator 13 becomes low level. Thus, the output of the points j and k are both brought to the low level, so that the points l, m and n are all brought to the low level. As a result, the points o and p becomes high level, and the pulse signals of the longest period are delivered from the AND gates 22 and 25. The pulse signals are then passed through OR gates 28 and 29 and AND gates 33 and 34 to the light-emitting diode energizing circuits 35 and 36, so that all of the light-emitting diode groups $E_2$, $E_1$, $E_4$ and $E_3$ re operated at the longest period (lowest rate).

Likewise, when a vehicle approaches the intersection from (B) or (D) or both directions along a second road, the point j is held at low level while the point k is brought to the high level. Thus, point l becomes high level while the point m becomes low level, and since the point p is brought into high level, a pulse signal of $\frac{1}{2}$ the repetition period (a rate twice as fast) is delivered from the AND gate 23, and operates the light-emitting diode energizing circuit 35 through OR gate 28 and AND gate 33, so that the light-emitting diode groups $E_2$ and $E_4$ directed to the first road are lit at a rate twice as fast. At the same time, the points m and n are brought into low level while the point is held at high level. As a consequence, a pulse signal of the slowest rate is delivered from the AND gate 25 to the diode energizing circuit 36 through OR gate 26 and AND gate 34, so that the light-emitting diode groups $E_1$ and $E_3$ are operated at the slowest rate. When the vehicle along the second road passes through the intersection, and the light received by the corresponding vehicle sensor is reduced, the voltage at the point d is reduced. The output of the comparator 13 of the sensor is therefore reduced to low level together with the output of OR gate 17. As a consequence, the points j and k are both brought to the low level, and all of the light-emitting diode groups $E_2$, $E_1$, $E_4$ and $E_3$ are operated at the slowest rate (or initial rate).

As described before, when a vehicle approaching the intersection from (A) or (C) direction or from both of the (A) and (C) directions are detected by the sensor or sensors, the point j becomes high level, while the point k becomes low level, thereby bringing the points 1 and into low level, and the point into high level. At this time, the point o becomes high level thereby lighting the diode groups $E_2$ and $E_4$ at the initial slow rate, while the point s becomes high level thereby lighting diode groups $E_1$ and $E_3$ at a rate twice as fast as the initial rate.

At the time of the above described operation, when a vehicle coming to the intersection from (B) or (D) direction or both are detected by the corresponding vehicle sensor the point k on the output side of the OR gate 17 becomes high level. Thus the point l becomes low level, while the point m becomes high level, and since the point among the points o, p, and q is brought to a high level, a pulse signal of $\frac{1}{2}$ of the longest period is delivered from the AND gate 23. Accordingly, the light-emitting diode groups $E_2$ and $E_4$ are operated at a rate twice as fast as the initial rate. At this time, since the point n is also held at high level, the point t among the points r, s and t becomes high level, so that a pulse signal of $\frac{1}{4}$ the repetition period (a rate four times as fast) is delivered from the AND gate 27, and the light-emitting diode groups $E_1$ and $E_3$ are operated at a rate four times as fast as the initial rate. When the vehicle approaching the intersection from (A) or (C) direction or both of these directions has passed through the intersections, the output point j as the OR gate 16 comes low level, so that the point l becomes high level, while the points m and n become low level. At this time, the point p among the points o, p and q becomes high level, and therefor a pulse signal of one half the period (a rate twice as fast) of that of the initial signal is delivered from the AND gate 23, and the light-emitting diode groups $E_2$ and $E_4$ are operated at the rate twice as fast. Furthermore, since the point r among the points r, s and t, becomes high level, the AND gate 25 delivers a pulse signal of the longest period, and therefore the light-emitting diode groups $E_1$ and $E_3$ are operated at the initial rate.

When the vehicles running along the (B) or (D) direction or both of the directions also have passed through the intersection, the outputs from the sensors $A_1$, $A_2$, $A_3$ and $A_4$ become low level, and the voltages of the output points j and k of the OR gates 16, 17 are thereby brought to the low level. Thus only the point among the points o, p and q becomes high level, and also only the point r among the points r, s and t becomes high level. As a consequence, the output pulse signal of longest period is delivered from both of the AND gates 22 and 25, and the light-emitting diode groups $E_2$, $E_1$, $E_4$ and $E_3$ are all operated at the initial rate.

Although the cases where the vehicles approach the intersection firstly from (A)-(C) directions and then from (B)-(C) directions have been described above, it is apparent that operations of the diode groups are similar to the above described cases regardless of the case where the vehicles approach the intersection firstly from (B)-(D) directions and then (A)-(C) directions, except that the sequences of varying rates of the operation of the diode groups are reversed.

In the morning when the ambient light gradually increases, the light quantities received by the phototransistors 4 in the sensors $A_1$, $A_2$, $A_3$ and $A_4$ also increase, and the voltage at the point c in each sensor rises. However, the rate of increase of the voltage of the point c is extremely slow, and hence the voltage of the point d is held at nearly zero volts, which is far lower than the reference voltage at the point e, so that the output of the comparator 13 is held at a low level, and the light-emitting diode groups $E_2$, $E_1$, $E_4$ and $E_3$ are operated at the initial rate. However, when the output voltage at the point a of the solar cell 2 becomes higher than the reference voltage at the point b, the output of the comparator 9 becomes low level thereby terminating the operation of the oscillator 37. Furthermore, the reset input of the octonary counter 30 becomes high level, so that the outputs as the points u, v and w are all brought into low level, thereby turning off the light emitting diode groups $E_2$, $E_1$, $E_4$ and $E_3$.

According to the lighting peg of the present invention, while the all-night flashing capability of the conventional device is maintained, the rate of pulsation of the light along one road is varied to $\frac{1}{2}$ or $\frac{1}{4}$ of the initial value when a vehicle approaches the intersection along the other road, so that not only the presence of the intersection is informed to the drivers of vehicles or pedestrians, a warning that a vehicle is approaching the intersection along the other road can be issued at the appropriate time, and the occurrence of collision accidents at the intersections having no traffic signals can be prevented.

What is claimed is:

1. A lighting peg with a variable pulsation rate, comprising:

a square outer casing provided with a solar cell and a battery, and adapted to be installed at a road intersection;

light-emitting diodes and a photoelectric conversion element provided on each side-surface of said outer casing;

an ambient light sensor for sensing light of a surrounding area;

a comparator for comparing an output voltage of said solar cell with a reference voltage and providing an output;

a pulse signal generating circuit operated by an output of said ambient light sensor so as to generate a number of pulse signals of different rates; wherein upon operation of said pulse signal generating circuit, said light-emitting diodes provided on all of the side surfaces being operated by one of said pulse signals having the lowest rate;

vehicle sensors on each of said sides of said casing, each comprising said photoelectric conversion element series connected with a variable resistor, a differential circuit connected across said variable resistor, and a comparator comparing an output of said differential circuit with a reference voltage; and a control circuit comprising OR gates, each receiving outputs of a pair of the vehicle sensors on opposite sides of said casing, discriminating circuits discriminating the outputs of the OR gates, and pulsation rate control circuits which control the rate of pulsation of the light emitted from said light emitting diodes toward said road intersection in accordance with those of the pulse signals generated from said pulse signal generating circuit.

2. The lighting peg with a variable pulsation rate according to claim 1 wherein said pulse generating circuit includes an octonary counter provided in combination with two OR gates and an inverter, so that three pulse signals having a slowest rate and twice and four times larger than the slowest rate are delivered from said signal generating circuit.

3. The lighting peg with a variable pulsation rate according to claim 2 wherein said discriminating circuits in combination deliver three outputs simultaneously, the conditions of which are varied in accordance with the outputs of said OR gates each receiving the outputs of a pair of said vehicle sensors sensing light of vehicles approaching the intersection from two opposite directions of one road.

4. The lighting peg with a variable pulsation rate according to claim 3 wherein each of said pulsation rate control circuits is made operable so that depending on the conditions of two of the three outputs delivered from said discriminating circuits, only one of three control lines in the pulsation rate control circuit is brought to a high level, whereby either one of said three pulse signals of different rates generates in said pulse signal generating circuit is delivered from said pulsation rate control circuit.

* * * * *